US006622951B1

(12) United States Patent
Recker et al.

(10) Patent No.: US 6,622,951 B1
(45) Date of Patent: Sep. 23, 2003

(54) HAMMER ASSEMBLY FOR WOOD REDUCING HAMMER MILLS AND OTHER COMMINUTING MACHINES AND METHODS OF MAKING AND USING IT

(75) Inventors: Jeffrey M. Recker, Winn, MI (US); Milan W. Robison, Winn, MI (US)

(73) Assignee: Mobark, Inc., Winn, MI (US)

( * ) Notice: Subject to any disclaimer, the term of this patent is extended or adjusted under 35 U.S.C. 154(b) by 506 days.

(21) Appl. No.: 09/670,428

(22) Filed: Sep. 26, 2000

Related U.S. Application Data

(60) Provisional application No. 60/159,174, filed on Oct. 13, 1999.

(51) Int. Cl.[7] ..... B02C 13/02

(52) U.S. Cl. ..... 241/195; 241/191; 241/197; 241/300.1; 241/300

(58) Field of Search ..... 241/191, 195, 241/197, 300.1, 300

(56) References Cited

U.S. PATENT DOCUMENTS

| | | | |
|---|---|---|---|
| 273,477 | A | 3/1883 | Dodge |
| 1,085,861 | A | 2/1914 | Haughton |
| 3,045,934 | A | 7/1962 | Eilers |
| 4,311,284 | A | 1/1982 | Ratcliff, Jr. |
| 4,344,581 | A | 8/1982 | Redemann |
| 5,158,126 | A | 10/1992 | Lang |
| 5,249,750 | A | 10/1993 | Gundlach . |
| 5,332,164 | A | 7/1994 | Page |
| 5,497,950 | A | 3/1996 | Schrodl |
| 5,507,441 | A | 4/1996 | De Boef |
| 5,611,496 | A | 3/1997 | Fleenor |
| 5,690,286 | A | 11/1997 | Dodd |
| 6,047,912 | A | 4/2000 | Smith |

*Primary Examiner*—William Hong
(74) *Attorney, Agent, or Firm*—Reising, Ethington, Barnes, Kisselle & Learman, P.C.

(57) ABSTRACT

A wood fragmenting rotor assembly has a drive shaft driving a series of radially projecting hammers. Replaceable fragmenting knives are removably secured to the leading portions of said hammers and have generally axially extending fragmenting edges. An impaling tool having a generally conical leading end is carried on the hammers radially inwardly of the edges to project a generally tangentially predetermined distance forwardly and provide an initial rigid work contacting portion ahead of and cooperating with the knife edges.

13 Claims, 7 Drawing Sheets

83
A
85
81
80
79
77
76
75
78
82
84

HAMMER ASSEMBLY FOR WOOD REDUCING HAMMER MILLS AND OTHER COMMINUTING MACHINES AND METHODS OF MAKING AND USING IT

The present application claims the priority of U.S. provisional application, Serial No. 60/159,174 filed Oct. 13, 1999.

BACKGROUND OF THE INVENTION

The invention relates to machinery for reducing waste wood, such as demolition debris, pallets, ties, large timbers, old lumber, stumps, brush, dead trees, and the like to particulates which are useful, for example, as mulch ground cover.

The machines widely used today for reducing such waste wood and like waste products are the tub grinder with its hammer mill underlying the floor opening in the tub, and the so-called force feed horizontal machines frequently referenced as "wood hogs" in which a swingably mounted feed roll cooperates with an underlying chain conveyor to feed waste wood to a rotary drum having reducing comminuters or hammers on its periphery.

In the past, hammer blocks, having forwardly projecting, spaced apart radially inner and outer elongate, carbide coated tooth edges have been used to fragment waste wood. The blocks can be rotated 180° to reposition the less rapidly wearing radially inner edge as the outer tooth edge, after the appearance of a certain amount of wear on the original outer edge. Such hammer blocks require quite frequent replacement, with the machines expensively in a "down" condition while the replacement is taking place. Moreover, the fragments produced by such toothed hammer blocks are of a somewhat bulky character. Also, on the market are conical tooth comminuting members mounted on support members which have no tooth edges. While such conical tooth members operate well to fragment wood products, they also tend to produce a relatively coarse or bulky product.

SUMMARY OF THE INVENTION

The present invention relates to a new concept involving marrying the conical tooth to a hammer knife block having at least one forwardly protruding axially extending tooth edge which cooperates with the conical tooth to produce a better product for use as a mulching agent. The hammer assembly of the invention produces more completely shredded, thinner, feathery looking fragments in a consistent manner. The conical or generally bullet-shaped projecting tooth of the new assembly first engages the wood piece to tend to impale it, and then tear it, and the torn piece is then immediately reduced further by the tooth edge or edges which follow closely behind the conical tooth. The forwardly projecting conical tooth further protects the hammer assembly in the sense that the edge or edges of the tooth or teeth wear less rapidly then previously. Moreover the conical tooth or teeth involved in the invention may incorporate a bolt-like member which secures the knife assembly in position on its hammer shoe.

One of the prime objects of the invention is to provide a hammer assembly which will operate to shred a more desirable mulching product in a very efficient and rapid manner.

Another object of the invention is to provide a hammer assembly having an extended effective service life, and which, when required, can be readily and rapidly adjusted or replaced.

A further object of the invention is to provide a hammer assembly which operates extremely effectively in tub grinders and wood hogs, particularly, and greatly improves the overall operation of these machines.

Other objects and advantages of the invention will become apparent with reference to the accompanying drawings and the accompanying descriptive matter.

BRIEF DESCRIPTION OF THE DRAWINGS

The presently preferred embodiment of the invention is disclosed in the following description and in the accompanying drawings, wherein.

DESCRIPTION OF THE PREFERRED EMBODIMENTS

Figure 1:
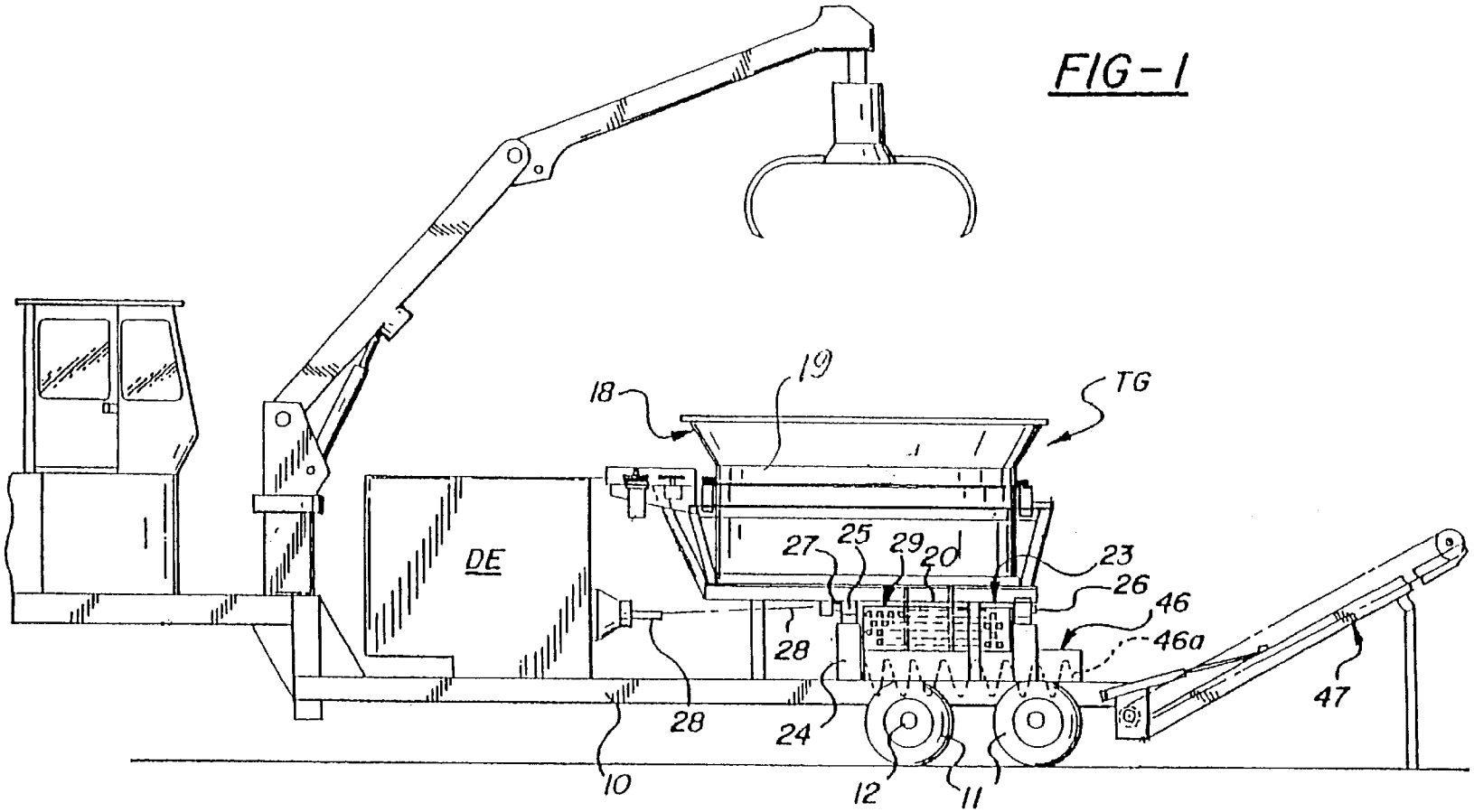
FIG. 1 is a somewhat schematic side elevational view of a tub grinder, which utilizes the invention.

Referring now more particularly in the first instance to FIGS. 1–6, in the first instance, the tub grinder, generally indicated at TG, includes a mobile chassis frame 10, mounted on wheels 11 which have axles 12 supporting the frame 10 via a suitable suspension system (not shown). The tub grinder depicted is of the type disclosed in the present assignee's U.S. Pat. No. 5,419,502, which is incorporated herein by reference.

The tub 18 is annular in configuration and includes a rotatably mounted side wall 19, and a bottom wall 20, which is fixed to the frame 10. The wall 20 includes a generally radially extending opening or slot, as usual, and below the slot is the comminuting hammer mill assembly, generally designated 23, which is mounted on the frame 10.

Figure 2:
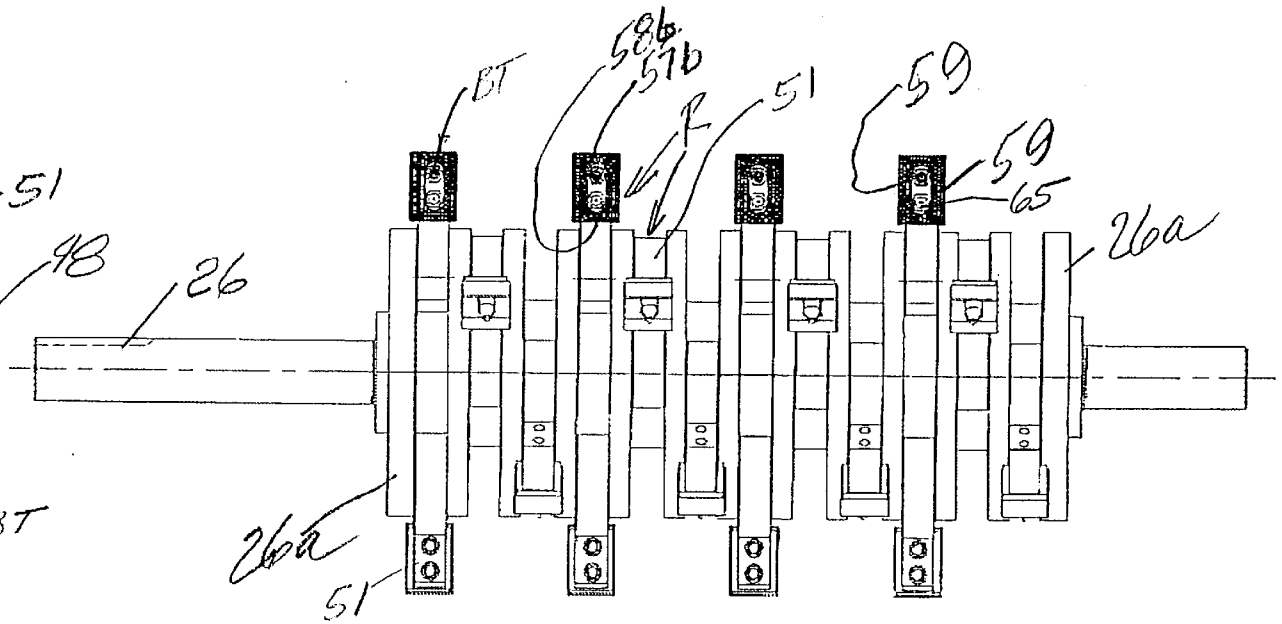
FIG. 2 is a schematic side elevational view of the rotor assembly which is used in the hammer mill employed in the tub grinder.
Figure 3:
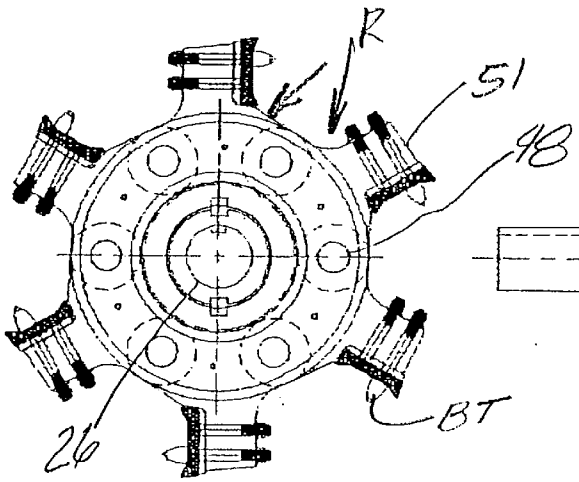
FIG. 3 is an end elevational view thereof.

Support framing 24 mounts the hammer mill assembly on the frame and bearings 25 are provided for journaling the shaft 26 of the comminuting rotor assembly shown more particularly in FIG. 2. The shaft 26 is coupled as at 27 to a shaft 28 driven by the diesel engine DE, which drives the otherwise fixed shaft 26 in rotation. Fixed on the shaft 26 between fixed end plate members 26*a* as shown in FIG. 2, is a helical array of side-by-side circumferentially staggered rotors R. Surrounding the lower portion of the hammer mill rotor assembly, is the usual screen grate 29, through which particles are delivered to a conveyor 46–46*a* and on to a discharge conveyor 47.

Figure 4:
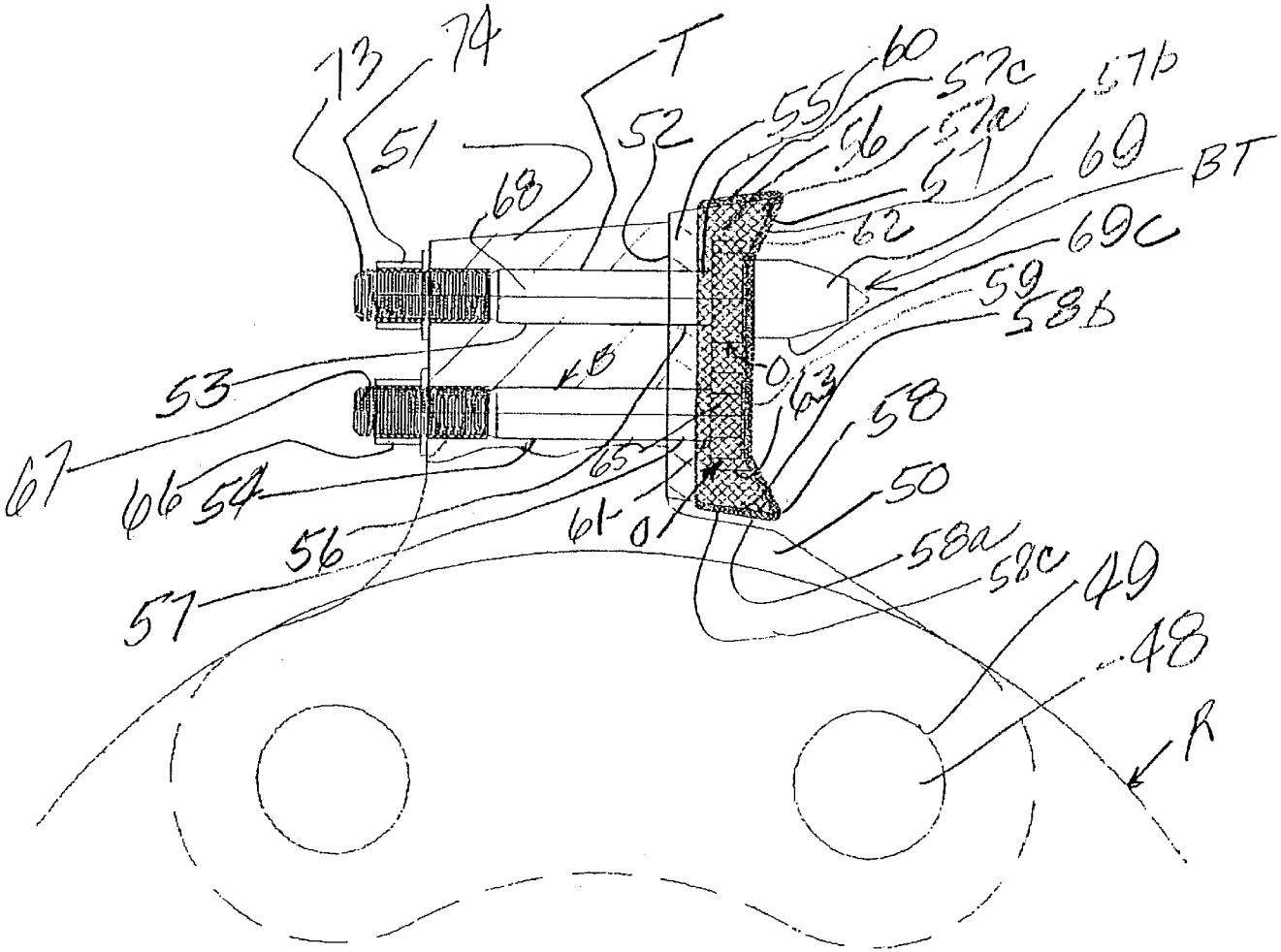
FIG. 4 is a greatly enlarged, schematic side elevational view of the new hammer assembly.

Affixed to rotor members or discs R, as with bolts 48 extending through bolt openings 49, as shown in FIG. 4, is the support or shoe 50 which supports the hammer assembly. Each of the shoes 50 has a generally radially extending and projecting integral head or hammer portion 51 provided with a flat front face 52. Each of the shoe heads 51, also, is provided with a pair of through openings 53 and 54. It is on the front face 52, in terms of the direction of rotation of the rotors R, that a hammer knife block or plate 55 is received and it will be seen that the plate 55 portrayed has openings 56 and 56*a*, which align with the openings 53 and 54.

Hammer knife plate 55 is provided with radially inner and outer tooth or knife edges 57 and 58 on forwardly projecting teeth 57*a* and 58*a*. While the double edge construction is greatly preferred, some knife constructions could utilize only radially outer edges 57. As FIGS. 2 and 4 indicate, the cutter edges 57 and 58 are coated with a hard, more wear resistant material than the steel of plate 55 along their edges as at 57*b* and 58*b*, and along their forwardly facing side edges as at 59. Also carbide, or otherwise, coated are the radially inner and outer edge relief surfaces 57*c* and 58*c*. The coating material can be welded or brazed to the surfaces in the well known manner. The plate 55 has radially inner and outer openings, each generally designated O, with rear portions 60 and 61 aligning respectively with the openings 56 and 56*a*, and with enlarged front portions 62 and 63 bolt-head-configured to receive bolt hex heads.

As previously, a bolt member B may extend through the openings 61, 57, and 54, with the bolt head 65 snugly received in the opening 63. Nuts 66 may then be employed to clamp the blocks or plates 55 to the shoe head portions 51.

Figure 6:
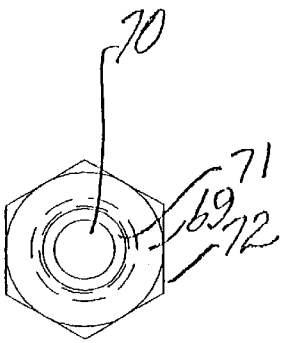
FIG. 6 is an end elevational view thereof.
Figure 5:
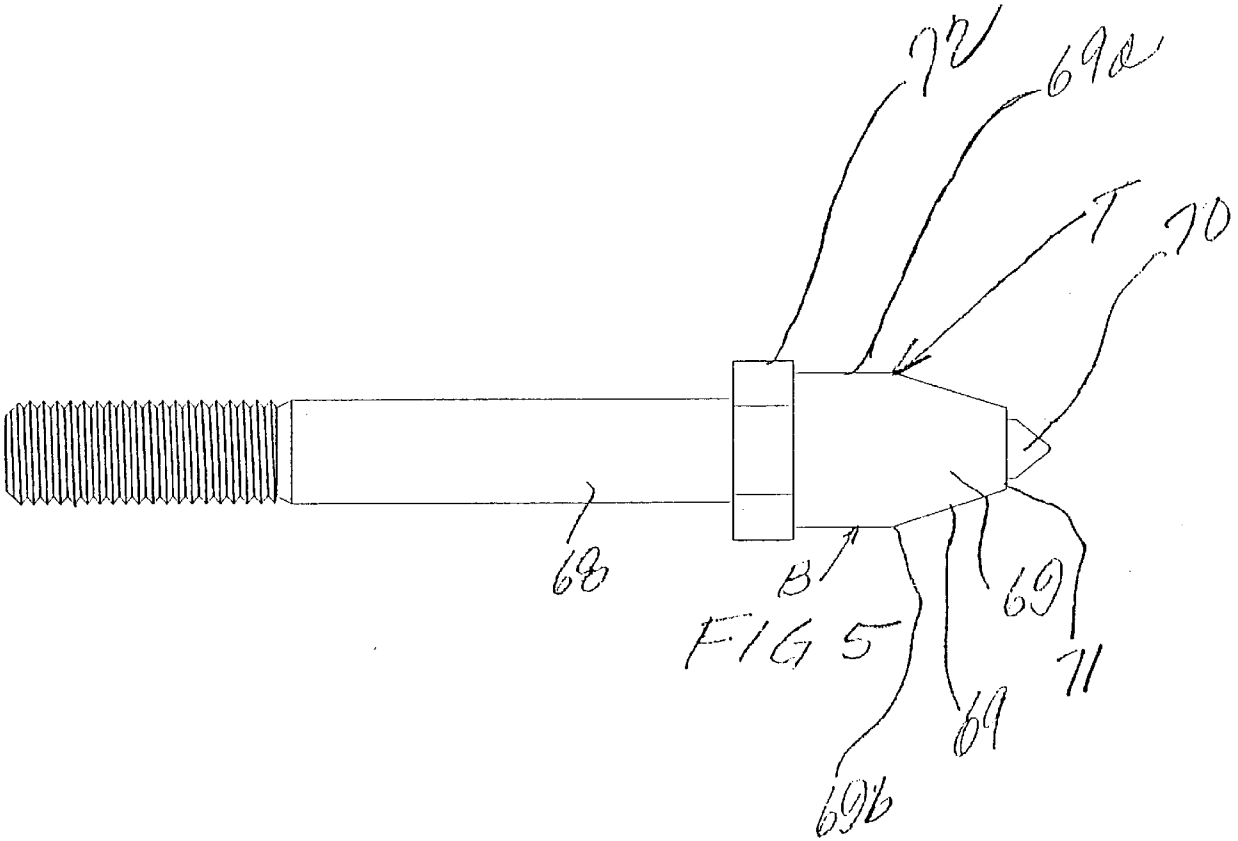
FIG. 5 is a greatly enlarged, side elevational view of the conical tool used in the hammer assembly.

Provided to extend through the openings 62, 56, and 53 is the shank portion 68 of a special impaling or work piercing tool member, generally designated T, which is particularly well shown in FIGS. 5 and 6. The tool member T includes a bullet-shaped frontal portion, generally designated BT, fronted by a preferably carbide conical tip 70, which is indented relative to a preferably carbide frustoconical portion 69, as shown at 71. Rearwardly of the portion 69 is a cylindrical portion 69*a*, connecting with a hex head 72, which matches and snugly fits into the opening 62 provided in the member 55. As FIG. 4 shows, the cylindrical portion 69*a* joins to the conical or frustoconical portion 69 at 69*b*.

In the embodiment disclosed in FIG. 4, it is the conical portion 69, carrying the tip 70, which projects forwardly of the edges 57 and 58, and this general orientation provides a very rigid construction. The special tool T performs a dual function in the sense that it also functions to assist the bolt B in securing the member 55 in position, the shank 68 of the tool T being threaded as at 73 so that the clamping can be accomplished using a nut 74.

Figure 7:
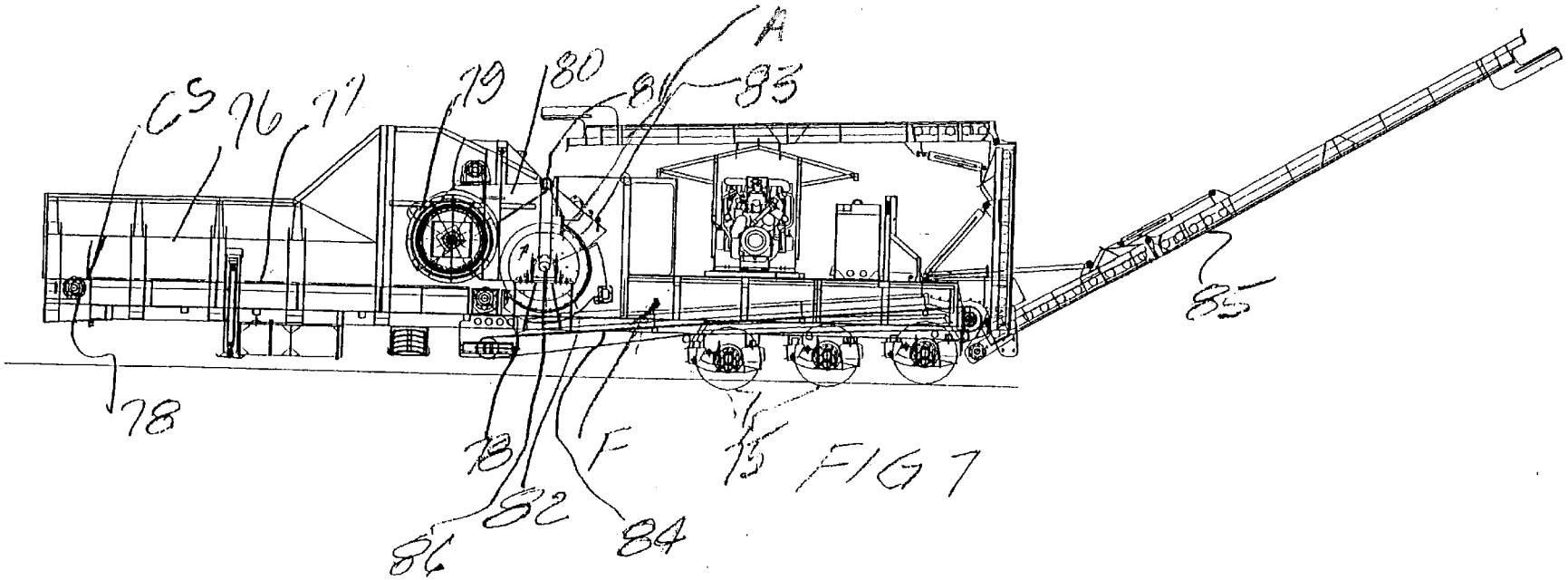
FIG. 7 is a side elevational view of a typical wood hog machine.

FIG. 7 shows a typical horizontal wood processing machine or wood hog, which is shown mounted on a trailer frame F, which may be readily towed to the site of use. The machine frame F is supported by rear wheels 75 and by suitable, vertically adjustable columns at the front end of the machine. Side walls 76 define a top open bin on the floor of which a wood receiving conveyor system, generally designated CS, is provided. The conveyor CS includes motor driven, longitudinally extending endless chains 77 traveling around suitable sprockets 78, and a driven material feed wheel, generally designated 79, rotatably mounted on a frame 80 which is pivoted at 81 for vertical movement, operates with the conveyor CS to constitute a feed works for feeding material to be comminuted to a comminuting drum, generally designated 82. Drum 82 travels in a direction of rotation with respect to an anvil A indicated by the arrow in FIG. 7. Provided beneath the drum 82 is a grate 83 which delivers properly fragmented chips to an underneath conveyor 84, leading rearwardly to a discharge conveyor section 85.

Figure 8:
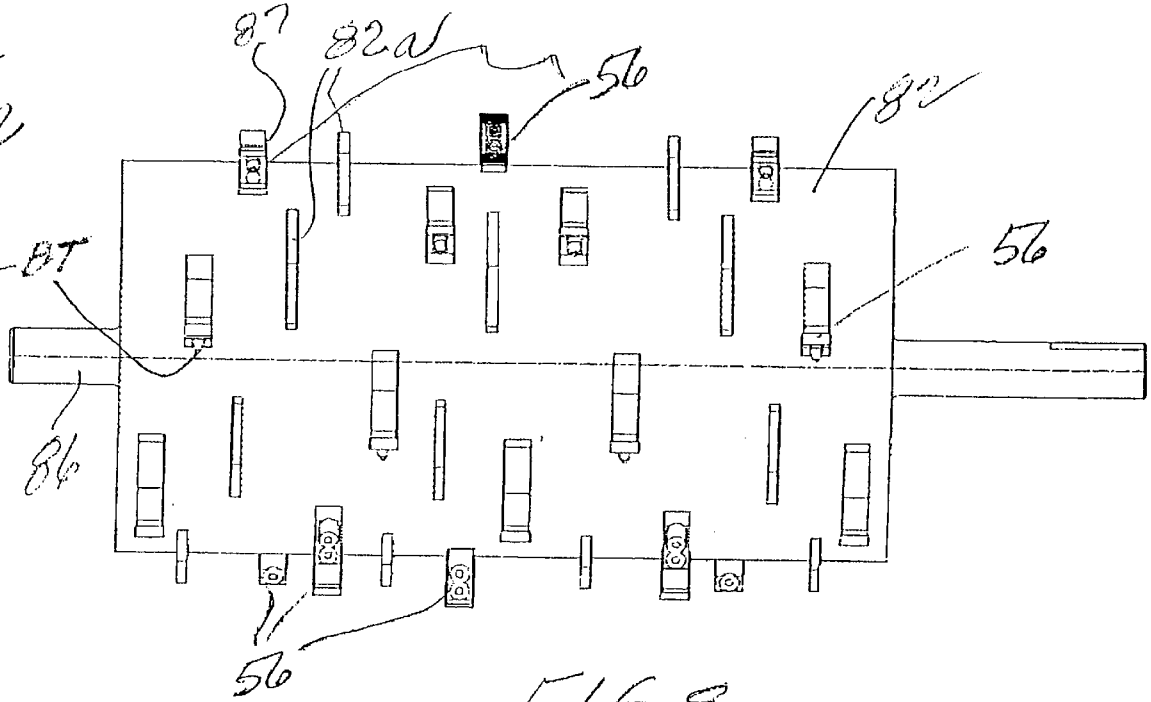
FIG. 8 is a greatly enlarged side elevational view of the drum assembly used on the wood hog.
Figure 9:
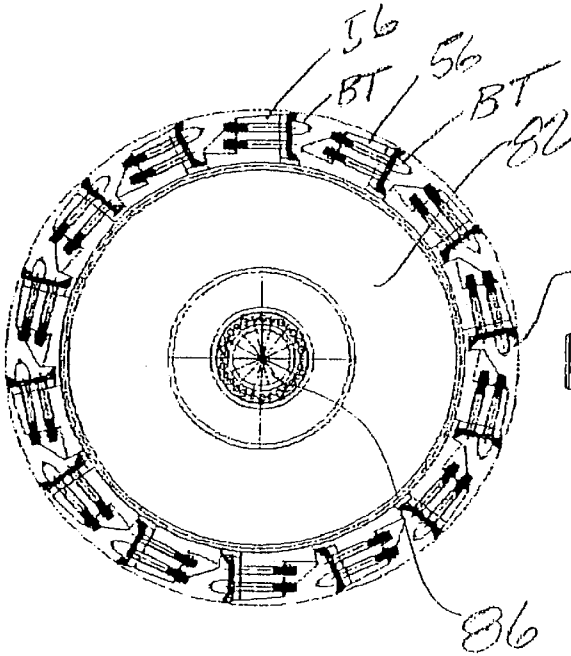
FIG. 9 is an end elevational view thereof.
Figures 10, 11:
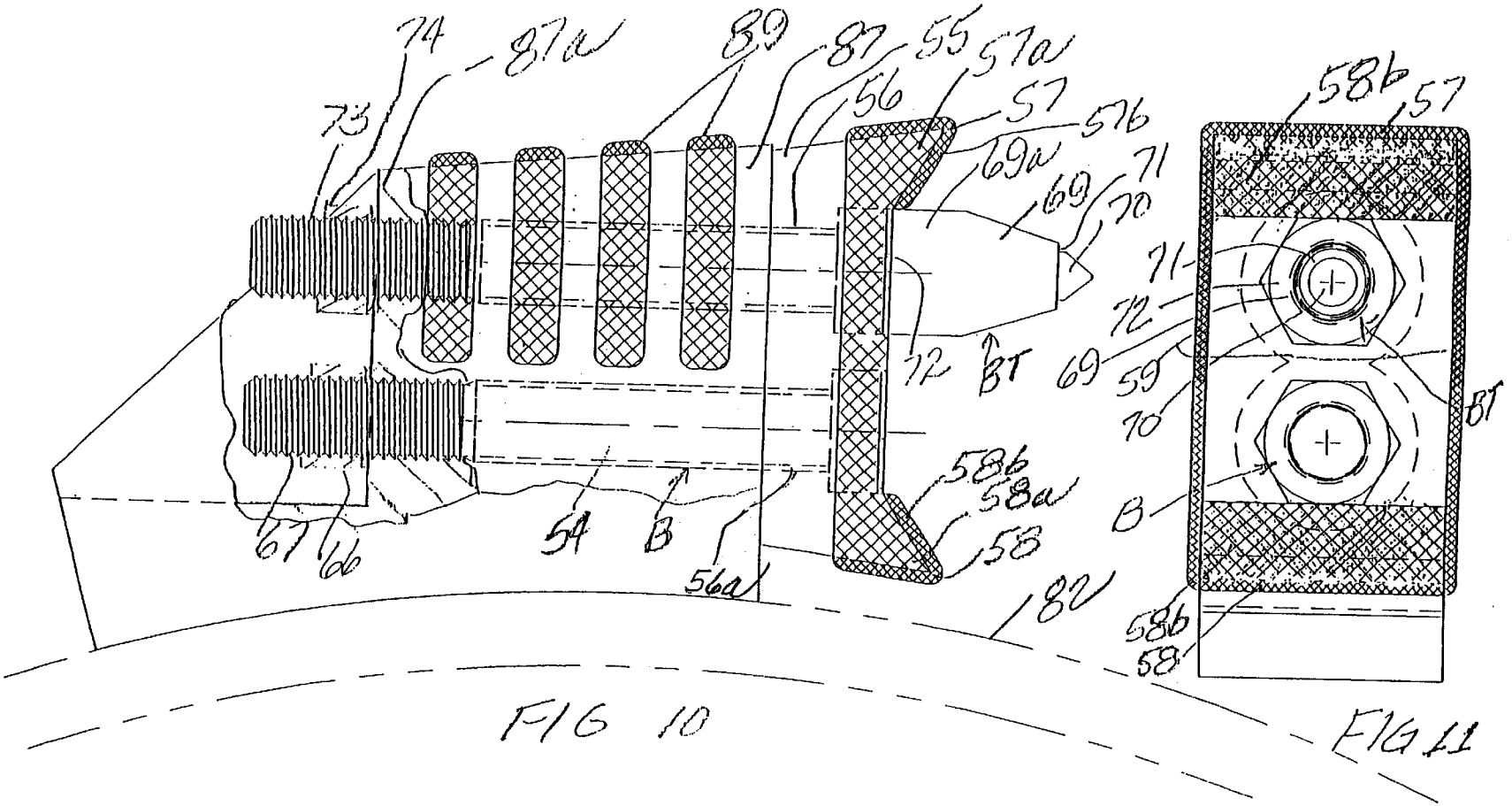
FIG. 10 is a greatly enlarged side elevational view of the hammer assembly of the invention; as used on the wood hog.
FIG. 11 is an end elevational view thereof.

FIGS. 8 and 9 show the comminuting drum 82 fixed on a shaft 86 and it will be seen that the hammer assemblies of the present invention are fixed on the periphery of the drum 82. As FIGS. 10 and 11 illustrate, fixed in openings 82*a* on the drum surface 82 are generally radially projecting heads, or hammers, or supports 87, corresponding to the shoe or hammer heads 51.

The hammer assembly is virtually identical to the hammer assembly previously described and its component parts are similarly identified with the same numerals as used previously. In FIG. 10, it will be noted that the rear end of radial support 87 is recessed as at 87*a* to better shield nuts 74. In this version, block 58 is provided forwardly of recess 87*a* with a series of spaced inversely U-shaped carbide beads 89, which extend along the top wall of the member 87 and down the sides thereof.

In operation, the wood product is first initially contacted by the leading ends 70 of the tool T and then impaled on the portions 69, which tend to rip or tear the material. This torn material is then immediately engaged by the carbide coated tooth edges 57, or 57 and 58, which further assist the fragmenting or comminuting action of the hammer assembly. This occurs in many instances while the front ends of the tools T, in effect, hold the work to greatly assist the fragmenting action. After initial fragmenting impact, the fragments are subjected to shearing action at the anvil A in FIG. 7 and finally to the reducing action of the grate as illustrated in the present assignees U.S. Pat. No. 5,713,525, also incorporated herein by reference.

While generally speaking, conical type tools have been used previously, as have the toothed members 55, the conical type tools T, as illustrated particularly in FIGS. 4–6 and 7–10, to our knowledge, have not been used in conjunction with a block having a tooth edge 57 or tooth edges 57 and 58. Here the tooth edges 57 and 58 are greatly protected by the conical tool head BT, which projects forwardly of the edges 57 and 58 and first impacts the material. With the edges 57 and 58 almost immediately thereafter contacting the material, an improved fragmenting action is achieved by the composite hammer assembly.

Hammer assemblies already in the field can be refitted with the tool members T by simply removing the bolt B which is used in the radially outer opening, and replacing it with the special tool T. In some instances, it may be desirable to use two tool members T in place of the two bolts B presently used in the field in openings 56 and 56*a*.

The disclosed embodiment is representative of a presently preferred form of the invention, but is intended to be illustrative rather than definitive thereof. The invention is defined in the claims.

We claim:

1. In a fragmenting rotor assembly for waste wood and other fragmentable material a. a drive shaft and mechanism for driving said shaft in a direction of rotation about an axis of rotation;

b. a series of radially projecting hammers situated along said axis and powered by said shaft, the hammers having a leading portion and a trailing portion relative to said direction of rotation;

c. replaceable fragmenting knives removably secured to the leading portions of said hammers having generally axially extending fragmenting edges; and d. an impaling tool having a generally conical front end rigidly carried on said hammers radially inwardly of said edges to project generally tangentially a predetermined distance forwardly of said edges and provide an initial work contacting portion ahead of and cooperating with said knife edges.

2. The rotor assembly of claim 1 wherein said knives are double edged and comprise plates with radially spaced inner and outer cutting edges, and said impaling tools extend adjacent said outer edges and remote from said inner edges.

3. The rotor assembly of claim 2 wherein said drive shaft mounts a drum having a peripheral surface and said hammers are fixed on said peripheral surface in circumferentially staggered formation.

4. The rotor assembly of claim 2 wherein said drive shaft mounts a series of discs and said hammers are fixed on said discs in circumferentially staggered formation.

5. The rotor assembly of claim 2 wherein said knives have radially spaced openings through them, and bores through said hammers leading from front to back communicate with each of said openings, and said impaling tools on said hammers have elongate shanks with threads thereon extending through said knife openings and hammer openings to mount said knives on said hammers.

6. The rotor assembly of claim 5 wherein said impaling tools have bolt head portions forming the front ends of said shanks and said knives have bolt-head-shaped openings within which said bolt head portions are received, and nuts bearing on said hammers cooperate with said threads on said impaling tool shanks to hold said knives and impaling tools in fixed position.

7. The rotor assembly of claim 6 wherein said impaling tools are provided to fix the radially outer portions of said knives, and bolts having heads fitting in said bolt-head-shaped openings are provided to fix the radially inner portions of said knives.

8. The rotor assembly of claim 2 wherein said generally conical front ends of said impaling tools comprise conical ends on frustroconical portions integrated with cylindrical portions and said radially outer knife edges substantially overhang said cylindrical portions.

9. The rotor assembly of claim 1 wherein said edges are coated with a hardened surface.

10. The rotor assembly of claim 1 wherein said knives have radially outer and front surfaces which are angled to provide relief, and said radially outer and front surfaces are coated with a carbide material.

11. In a method of operating a fragmenting rotor assembly for waste wood and other fragmentable material incorporating a drive shaft and mechanism for driving said shaft in a direction of rotation about an axis of rotation, a series of radially projecting hammers situated along said axis of rotation and powered by said shaft with the hammers having a leading portion and a trailing portion relative to said direction of rotation, replaceable fragmenting knives removably secured to the leading portions of said hammers having generally axially extending knife edges, and an elongate impaling tool having a generally conical front piercing portion rigidly carried on said hammers radially inwardly of said edges to project in a generally tangential direction a predetermined distance forwardly of said edges and provide an initial contacting portion ahead of and cooperating with said knife edges; the method comprising:

a. prior to engaging the work with each of said radially outer knife edges, engaging the work with an impaling tool to pierce and tear the work while protecting the knife edges; and b. immediately thereafter contacting the work with said knife edges to fragment work held for engagement by said tools.

12. The method of claim 11 comprising providing radially inner knife edges radially inboard of said impaling tool.

13. The method of claim 12 wherein radially inner and radially outer knife edges are provided on knife plates on the front faces of said hammers and said impaling tools are carried by said knife plates and perform the dual function of carrying said knife plates and fixing them in position, said impaling tools being axially removable to permit said knife plates to be rotated 180°, and then reinsertable in position to hold said knife plates.

* * * * *